US006968638B2

(12) United States Patent
Gonzalez Palacio

(10) Patent No.: US 6,968,638 B2
(45) Date of Patent: Nov. 29, 2005

(54) EDUCATIONAL SHOE

(75) Inventor: Luis A. Gonzalez Palacio, Boca Raton, FL (US)

(73) Assignee: BBC International, Ltd., Boca Raton, FL (US)

( * ) Notice: Subject to any disclaimer, the term of this patent is extended or adjusted under 35 U.S.C. 154(b) by 95 days.

(21) Appl. No.: 10/732,081

(22) Filed: Dec. 10, 2003

(65) Prior Publication Data

US 2005/0126041 A1 Jun. 16, 2005

(51) Int. Cl.[7] ..... A43B 3/30

(52) U.S. Cl. ..... 36/112; 36/50.1; 434/260; 24/713.1

(58) Field of Search ..... 36/112, 50.1, 51; 434/259, 260, 397; D2/900, 897, 898; 24/713, 24/713.1

(56) References Cited

U.S. PATENT DOCUMENTS

| | | | | | |
|---|---|---|---|---|---|
| 668,408 | A | * | 2/1901 | Kalina | 24/379.1 |
| 1,353,614 | A | * | 9/1920 | Ross | 36/50.1 |
| 1,772,238 | A | * | 8/1930 | Bonne | 24/575.1 |
| 2,313,874 | A | * | 3/1943 | Hume | 434/260 |
| 2,839,804 | A | * | 6/1958 | Benoit | 24/301 |
| 2,991,561 | A | | 7/1961 | Moore et al. | 35/8 |
| 3,906,642 | A | | 9/1975 | Cohen | 35/8 R |
| 4,017,984 | A | * | 4/1977 | Bonfigli | 434/260 |
| 4,081,916 | A | | 4/1978 | Salisbury | 36/50 |
| 4,253,197 | A | | 3/1981 | Posta | 2/69 |
| 4,414,761 | A | | 11/1983 | Mahood | 36/50 |
| D272,962 | S | | 3/1984 | Clarvit | D2/278 |
| 4,486,965 | A | * | 12/1984 | Friton | 36/50.1 |
| 4,519,781 | A | | 5/1985 | Boyd | 434/156 |
| 4,592,154 | A | * | 6/1986 | Oatman | 36/114 |
| 5,027,482 | A | | 7/1991 | Torppey | 24/712.1 |
| 5,240,418 | A | | 8/1993 | Silverman et al. | 434/260 |
| 5,269,690 | A | | 12/1993 | Zigon | 434/397 |
| 5,282,749 | A | | 2/1994 | Ketch | 434/395 |
| 5,353,483 | A | | 10/1994 | Louviere | 24/712.1 |
| 5,357,691 | A | | 10/1994 | Hyde et al. | 36/54 |
| 5,572,774 | A | | 11/1996 | Duren | 24/306 |
| 5,611,692 | A | | 3/1997 | Gehrdes | 434/260 |
| 5,673,499 | A | | 10/1997 | Attilieni | 36/54 |
| 5,907,912 | A | | 6/1999 | Alaimo | 36/50.1 |

* cited by examiner

*Primary Examiner*—Ted Kavanaugh
(74) *Attorney, Agent, or Firm*—Holland & Knight LLP

(57) ABSTRACT

An article of footwear includes an outsole connected to an upper having a toe portion, a heel portion, a foot insertion opening and a tongue which defines two, opposed sides of the upper extending between the heel and toe portions. One end of each of a number of straps is fixed to one side of the upper, and the free end of each strap is formed with a tab having a unique indicia such as a different shape, number and/or color. A series of patches are mounted to the other side of the upper, opposite the straps, and each patch includes a matching indicia corresponding to one of the tabs on the straps. The tabs and patches have cooperating hook and loop fastening material or other fasteners to connect them together and secure the straps on the article of footwear.

19 Claims, 3 Drawing Sheets

EDUCATIONAL SHOE

FIELD OF THE INVENTION

This invention relates to an article of footwear, and, more particularly, to an educational shoe which assists young children in recognizing shapes, colors and how laces cross over one another on a shoe which ties.

BACKGROUND OF THE INVENTION

A popular use of hook and loop fastening elements has been in articles of footwear for young children who are not yet old enough to be able to tie shoe laces. In most designs, one end of each of a number of straps is mounted to the upper of the shoe, boot or other article of footwear on one side of the tongue of the shoe. The underside of each strap is provided with hook (or loop) fastening elements, and discrete areas on the upper on the opposite side of the tongue mount cooperating loop (or hook) fastening elements. In order to tighten the upper around the foot when it is inserted into the shoe, the straps are extended from one side of the upper, across the tongue and then to the discrete areas on the other side of the upper where the cooperating hook and loop fastening elements engage one another to hold the straps in place. Usually, the straps extend horizontally across the front of the shoe and do not overlap or otherwise contact one another when fastened. Shoes having hook and loop fastening elements of the type described above are convenient and easy for those helping a child to put on his or her shoes, and, as the child gets older, he or she can do it alone. But at some point, the child needs to learn about tie shoes.

Attempts have been made in the prior art to design footwear having some educational value in teaching children how to properly lace and/or tie their shoes. For example, U.S. Pat. No. 5,240,418 to Silverman et al discloses a shoe in which a continuous lace has one color on half of its length and another color on the other half. The upper, in turn, has eyelets of matching color so that a child is prompted to insert the appropriate portion of the lace into the corresponding eyelet to properly lace his or her shoe. See also U.S. Pat. No. 3,906,642 to Cohen.

A variation of the Silverman et al design is shown in U.S. Pat. No. 2,991,561 to Moore et al in which opposite ends of a continuous lace are formed with different shapes, e.g. square, triangle etc. The eyelets of the shoe have a shape corresponding to the lace ends, and alternate along the upper so that the shoe is properly laced by inserting an end of the lace into the correspondingly shaped eyelet.

SUMMARY OF THE INVENTION

The article of footwear of this invention includes an outsole connected to an upper having a toe portion, heel portion, a foot insertion opening and a tongue which defines two, opposed sides of the upper extending between the heel and toe portions. One end of each of a number of straps is fixed to one side of the upper, and the free end of each strap is formed with a tab. Each tab has a different indicia, such as a shape, e.g. circle, square, triangle etc., number and/or a different color. A series of patches are mounted to the other side of the upper, i.e. opposite the straps, and each patch is formed with a matching indicia corresponding to one of the tabs on the straps. The tabs and patches have cooperating hook and loop fastening elements to secure them together upon contact with one another.

An important aspect of this invention is the educational benefit and enjoyment provided to young children in learning how to fasten their own shoes. The patches on one side of the upper are offset from the correspondingly shaped and/or colored tabs on the strap mounted to the opposite side of the upper. In the preferred embodiment, if the child matches the same shaped or colored tab with a corresponding patch, the straps cross over one another to simulate the look of the laces of a shoe. The shoe of this invention thus helps teach children to recognize different shapes and colors, and also to understand what the laces of a tie shoe look like.

In addition to the matching shapes and/or colors of the tabs and patches, the side of each tab opposite the hook or loop fastening elements may be marked with a letter of the alphabet. When the laces of the shoe are properly fastened to the upper, the exposed side of the tabs collectively spell a word such as a name or the like. This aspect of the invention assists the child in learning letters and the spelling of the name of a favorite character, e.g. "Elmo" or some other name.

BRIEF DESCRIPTION OF THE DRAWINGS

The structure, operation and advantages of a presently preferred embodiment of this invention will become further apparent upon consideration of the following description, taken in conjunction with the accompanying drawings, wherein.

DETAILED DESCRIPTION OF THE INVENTION

Figure 1:
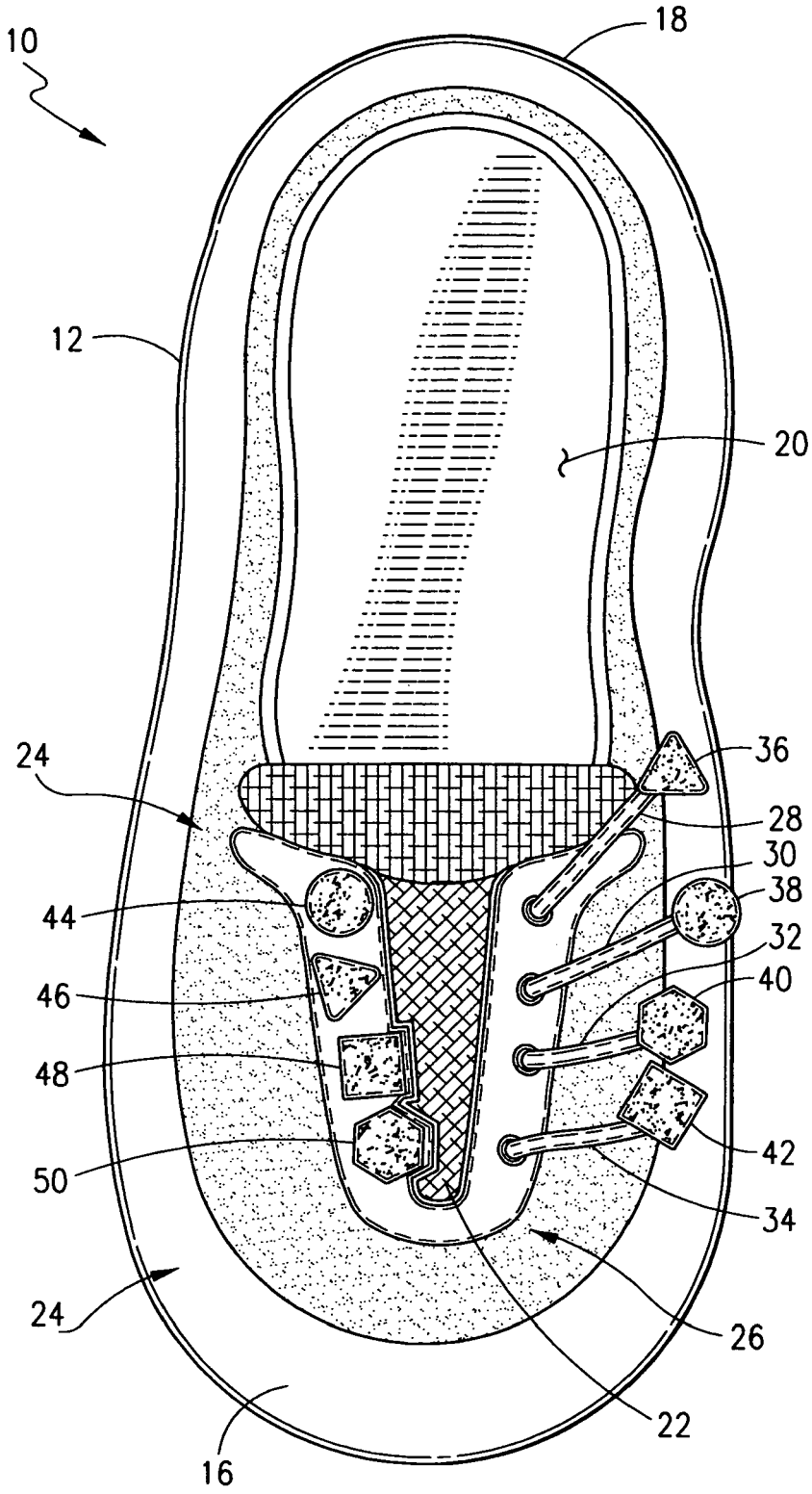
FIG. 1 is a perspective view of a shoe incorporating the matching tabs and patches of this invention in the open position.
Figure 2:
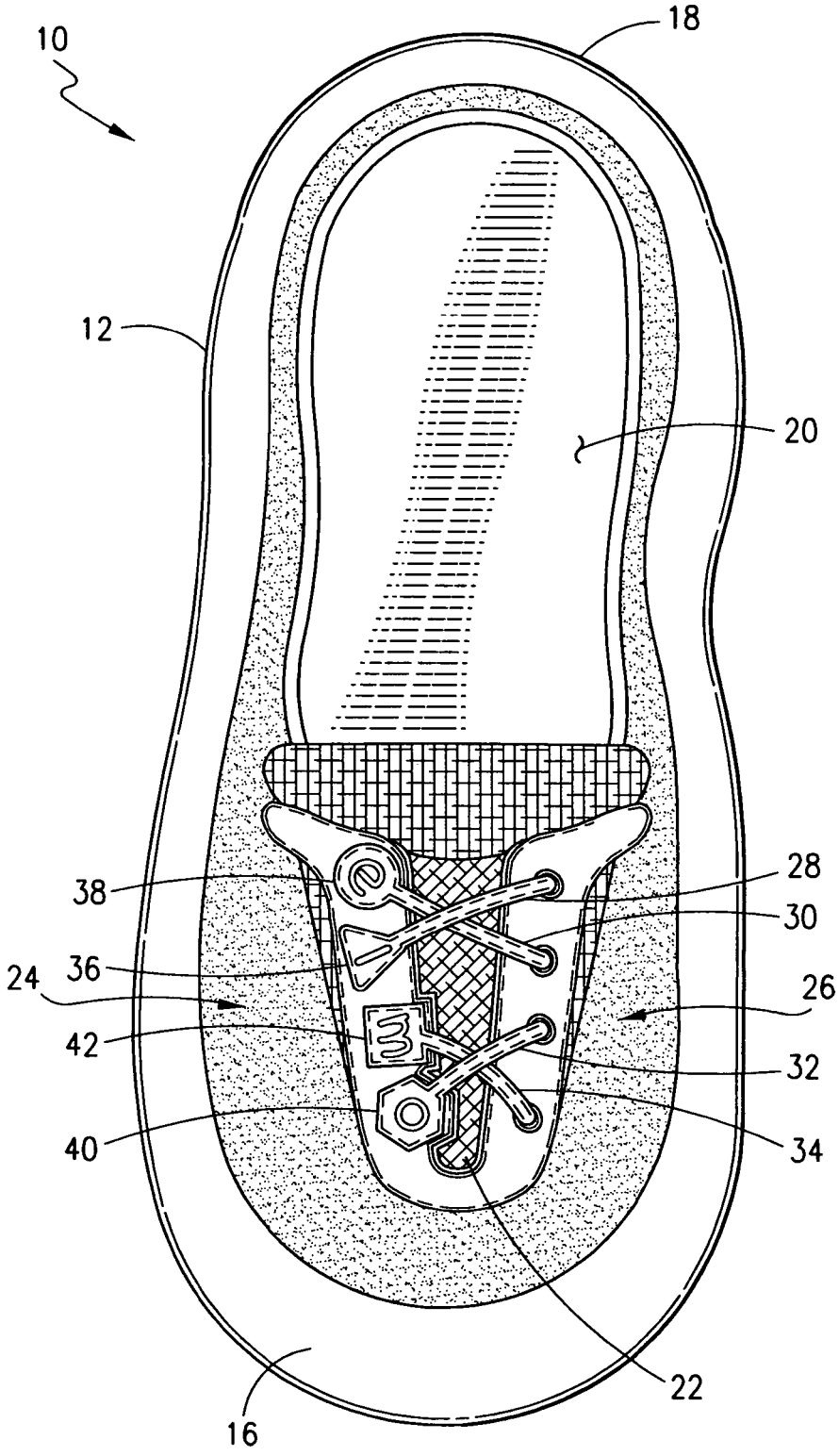
FIG. 2 is a plan view of the shoe of FIG. 1 wherein the tabs and patches are connected to one another.

Referring initially to FIGS. 1 and 2, a shoe 10 is depicted having an outsole 12 connected to an upper 14. The upper 14 has a toe portion 16, a heel portion 18, a foot receiving opening 20 and a tongue 22 which divides the upper into one side portion 24 and a second side portion 26. It should be understood that shoe 10 is shown to illustrate the structure and operation of the subject invention, and the term "shoe" is intended to be broadly construed to include any article of footwear normally worn on the feet such as boots, sandals etc. Additionally, although a tongue 22 is shown in the Figs., the shoe 10 may be constructed without a tongue.

In the embodiment of FIGS. 1 and 2, the shoe 10 is provided with four straps 28, 30, 32 and 34. One end of each strap 28–34 is mounted to the side portion 26 of the upper 14, and straps 28–34 are spaced from one another in between the foot receiving opening 20 and toe portion 16 of the shoe 10. The free end of strap 28 mounts a tab 36 in the shape of a triangle, strap 30 has a circular-shaped tab 38, a hexagonal-shaped tab 40 is mounted at the free end of strap 32 and strap 34 has a tab 42 in the shape of a square. In addition, or as an alternative to the different shapes of the tabs 36–42, they may be provided with different colors.

The straps 28–34 and tabs 36–42 are preferably formed of cloth, plastic or other material capable of sustaining a pull force on the order of about ten pounds. The "underside" of each tab 36–42, i.e. the surface presented in FIG. 1 of the drawings, is provided with hook and loop fastening material depicted schematically in the Figs. The "exposed" side of each tab 36–42, as shown in FIG. 2, is preferably marked with a letter of the alphabet e.g. "e," "l," "m" and "o."

The side portion 24 of the upper 16 on the opposite side of the tongue 22 mounts four spaced patches 44, 46, 48 and 50 in the shape of a circle, triangle, square and hexagon, respectively. Each patch 44–50 may also be provided with a color which matches that of one of the tabs 36–42, as described below. The exposed surface of each patch 44–50 receives hook and loop fastening material to interlock with that mounted on the tabs 36–42.

As seen in FIG. 2, the straps 28–34 are extended from the side portion 26 of the upper 14, across the tongue 22 to the other side 24 of the upper 14 to secure the shoe on the foot of the wearer. When the child affixes each tab 36–42 to a patch 44–50 having the corresponding shape and/or color, the straps 28, 30 and the straps 32, 34 cross over one another to resemble the laces of a tie shoe. Additionally, the letters appearing on the exposed side of the tabs 28–34 spell a name or the like, such as "Elmo," when the child matches the tab 36–42 with a corresponding patch 44–50. As such, the shoe 10 of this invention aids in teaching young children shapes, colors and letters of the alphabet while they learn to put on their own shoes.

Figure 3:
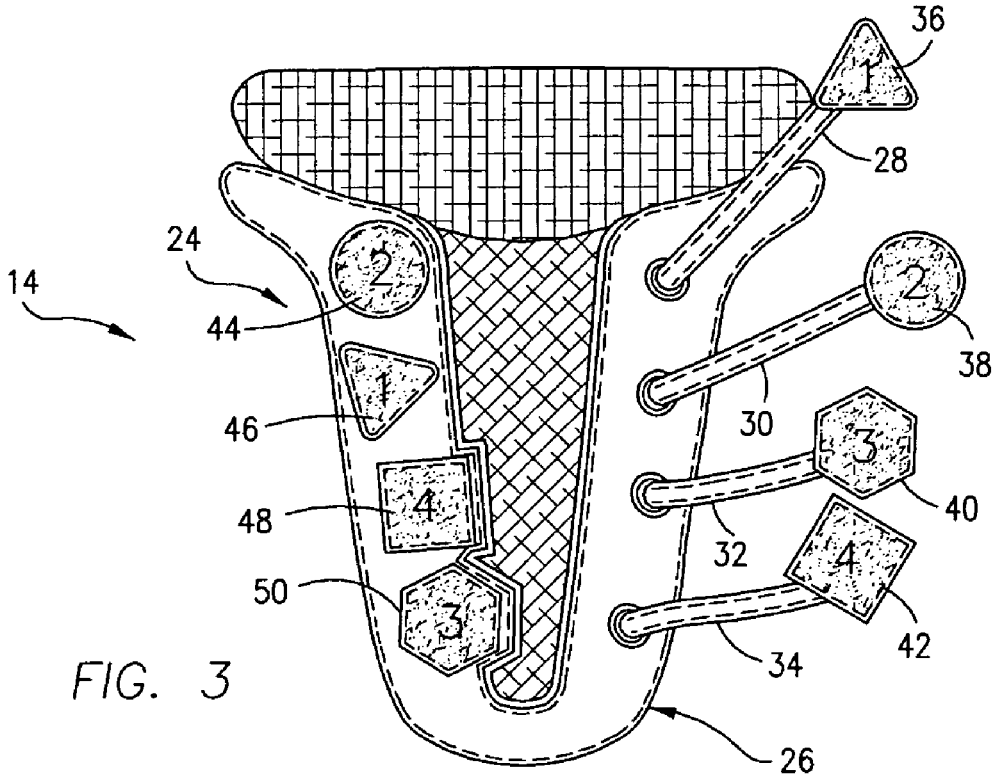
FIG. 3 is a partial view of the shoe upper of FIG. 1 except showing an additional numeric indicia on the matching tabs and patches.

Referring now to FIG. 3, a portion of the upper 14 of the shoe 10 in FIG. 1 is shown in which an additional indicia is provided on the tabs 36–42 of respective straps 28–34, and on the patches 44– 50. In this embodiment, the hook and loop fastening material affixed to the underside of the tabs 36–42 is embroidered with a number, e.g., 1, 2, 3 and 4, and these numbers match corresponding numbers or indicia on the patches 44–50, respectively. Although both the tabs 36–42 and patches 44–50 are shown with matching shapes in FIGS. 1 and 2, the shapes thereof need not match in this embodiment since matching indicia in the form of numbers on the tabs 36–42 and patches 44–50 are employed.

Figure 4:
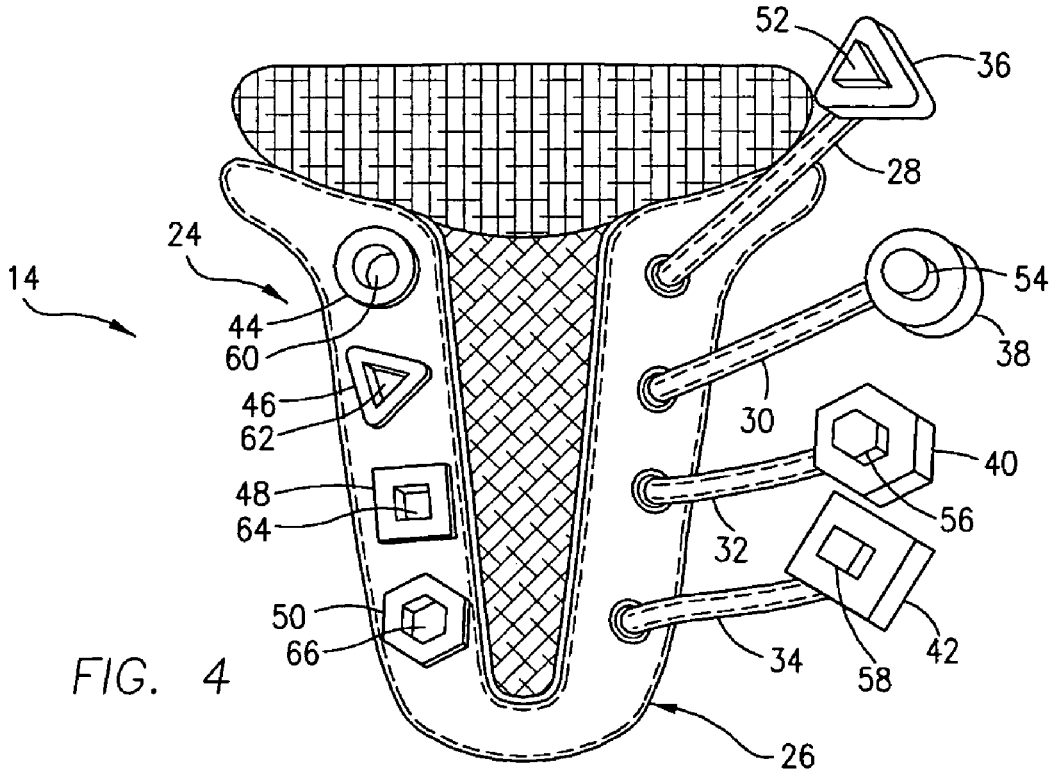
FIG. 4 is a partial view of the upper of a shoe similar to FIG. 1 except depicting snap closures with male elements of different shape on the tabs and matching female elements on the patches.

A still further embodiment of this invention is shown in FIG. 4 in which the hook and loop fastening material of the previously described embodiments is eliminated and replaced by snap closures. A portion of the upper 14 of the shoe 10 is depicted in FIG. 4 wherein the tabs 36, 38, 40 and 42 are each shown mounting a male element of a snap-type closure having the same shape as respective tabs 36–42. The tab 36 mounts a triangular-shaped male element 52, tab 38 mounts a circular-shaped male element 54, tab 40 mounts a hexagon-shaped male element 56 and tab 42 mounts a square-shaped male element 58. The patches 44, 46, 48 and 50 mount correspondingly shaped female elements 60, 62, 64 and 66, respectively, of the snap closures.

In the embodiment depicted in FIG. 4, the straps 28–34 crisscross one another as in the previously described embodiments. The male elements 52–58 of the snap closures carried by the tabs 36– 42 are inserted into the correspondingly shaped female elements 60–66 of the snap closures mounted to the patches 44–50 to secure the straps 28–34 in place. It should be understood that while the male and female elements 52–58 and 60–66 of the snap closures are depicted as having the same shape as the tabs 36–42 and patches 44–50, the tabs 36–42 and patches 44–50 can all be formed of the same shape so that the only matching indicia is between the male and female elements of the snap closures.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, in the preferred embodiment of this invention the straps 28–34 cross over one another when secured to the shoe 10. It is contemplated that the straps 28–34 could extend straight across from one side portion 24 of the shoe 10 to the other side portion 26, and not crisscross, while employing the same matching indicia on the tabs 36–42 and patches 44–50 as in any of the embodiments described herein. Additionally, the term "indicia" is meant to be broadly construed as essentially any matching shape, color, number or other designation which comprises or appears on the tabs 36–42 and patches 44–50. Further, although hook and loop fastening material and snap closures are depicted in the preferred embodiments for securing the tabs 36–42 to the patches 44–50, essentially any other type of closure device is considered within the scope of this invention.

Therefore, it is intended that the invention not be limited to the particular embodiment disclosed as the best mode contemplated for carrying out this invention, but that the invention will include all embodiments falling within the scope of the appended claims.

I claim:

1. An article of footwear, comprising:

an outsole;

an upper affixed to said outsole, said upper including a first side portion and a second side portion spaced from said first side portion;

a number of spaced straps each having a first end mounted to said first side portion of said upper, and a second end formed with a tab having an indicia, said indicia of each of said tabs being unique to that tab and different from said indicia of every one of the other of said tabs;

a number of spaced patches mounted to said second side portion of said upper, each of said patches having a matching indicia which corresponds to said indicia of one of said tabs; and said straps being extendable from said first side portion to said second side portion, said indicia of said tab on each strap engaging a matching indicia of a corresponding patch.

2. The article of footwear of claim 1 in which said indicia of each of said tabs of said straps is a different shape.

3. The article of footwear of claim 2 in which said matching indicia of each of said patches is a shape corresponding to said shape of one of said tabs.

4. The article of footwear of claim 1 in which said indicia of each of said tabs of said straps is a different color.

5. The article of footwear of claim 4 in which said matching indicia of each of said patches is a color corresponding to the color of one of said tabs.

6. The article of footwear of claim 1 in which each of said tabs of said straps mounts a male element of a snap closure having a different shape, and each of said patches mounts a female element of a snap closure having a shape which matches that of one of said male elements.

7. The article of footwear of claim 1 in which said straps cross over one another when extended from said first side portion to said second side portion to simulate the laces of a shoe.

8. The article of footwear of claim 1 in which each of said tabs has a first side and a second side, said first side of each of said tabs being marked with a letter of the alphabet, said letters on said tabs of said straps collectively spelling a word when placed in engagement with a corresponding patch.

9. The article of footwear of claim 8 in which said second side of each of said tabs is provided with said indicia.

10. The article of footwear of claim 9 in which said indicia on said second side of each of said tabs is a number, and said matching indicia on each of said patches is a number which corresponds to said number on one of said tabs.

11. An article of footwear, comprising:

an outsole;

an upper affixed to said outsole, said upper including a first side portion, a second side portion spaced from said first side portion, a toe portion, a heel portion and a foot receiving opening located between said heel and toe portions;

a number of straps each having a first end mounted to said first side portion of said upper and a second end formed with a tab having an indicia, said indicia of each of said tabs being unique to that tab and different from said indicia of every one of the other of said tabs, said straps being spaced from one another in a direction from said foot receiving opening toward said toe;

a number of patches mounted to said second side portion each having a matching indicia which corresponds to said indicia of one of said tabs, said patches being spaced from one another in a direction from said foot receiving opening toward said toe; and said straps being extendable from said first side portion to said second side portion so that each of said tabs engages one of said patches, said straps criss-crossing one another to simulate the appearance of the laces of a shoe when said indicia of each tab is placed into engagement with said matching indicia of a corresponding patch.

12. The article of footwear of claim 11 in which said indicia of each of said tabs of said straps is a different shape.

13. The article of footwear of claim 11 in which said matching indicia on each of said patches is a shape corresponding to said shape of one of said tabs.

14. The article of footwear of claim 11 in which said indicia on each of said tabs of said straps is a different color.

15. The article of footwear of claim 14 in which said matching indicia of each of said patches is a color corresponding to the color of one of said tabs.

16. The article of footwear of claim 11 in which each of said tabs of said straps mounts a male element of a snap closure having a different shape, and each of said patches mounts a female element of a snap closure having a shape which matches that of one of said male elements.

17. The article of footwear of claim 11 in which each of said tabs has a first side and a second side, said first side of each of said tabs being marked with a letter of the alphabet, said letters on said tabs of said straps collectively spelling a word when placed in engagement with a corresponding patch.

18. The article of footwear of claim 17 in which said second side of each of said tabs is provided with said indicia.

19. The article of footwear of claim 18 in which said indicia on said second side of each of said tabs is a number, and said matching indicia on each of said patches is a number which corresponds to said number on one of said tabs.

* * * * *